US007644529B2

(12) United States Patent
Hopper et al.

(10) Patent No.: US 7,644,529 B2
(45) Date of Patent: Jan. 12, 2010

(54) RIFLE BOLT CLEANING TOOL

(75) Inventors: James Vester Hopper, Durango, CO (US); Sam Gilliam Johnson, Douglas, WY (US)

(73) Assignee: Combat Application Tools, Inc., Douglas, WY (US)

( * ) Notice: Subject to any disclaimer, the term of this patent is extended or adjusted under 35 U.S.C. 154(b) by 0 days.

(21) Appl. No.: 12/348,297

(22) Filed: Jan. 4, 2009

(65) Prior Publication Data

US 2009/0178324 A1 Jul. 16, 2009

Related U.S. Application Data

(60) Provisional application No. 61/010,693, filed on Jan. 11, 2008.

(51) Int. Cl.
*F41A 29/02* (2006.01)

(52) U.S. Cl. ..... 42/90; 42/108; 15/93.1

(58) Field of Classification Search ..... 42/90, 42/95, 108; 15/93.1
See application file for complete search history.

(56) References Cited

U.S. PATENT DOCUMENTS

| | | | | |
|---|---|---|---|---|
| 816,570 | A | 4/1906 | Edmonds | |
| 1,121,526 | A | 12/1914 | Montague | |
| 2,896,495 | A | 7/1959 | Crawford | |
| 3,602,935 | A | 9/1971 | McDonnell | |
| 3,708,820 | A | 1/1973 | Schultea | |
| 3,765,045 | A | 10/1973 | Schneider et al. | |
| 3,956,787 | A | 5/1976 | Crumpacker | |
| 4,324,018 | A * | 4/1982 | Olsson | 15/236.03 |
| 4,468,829 | A | 9/1984 | Christensen | |
| 4,499,625 | A | 2/1985 | Bottomley | |
| 4,630,978 | A | 12/1986 | Keiser et al. | |
| 4,887,508 | A | 12/1989 | Bianco | |
| 5,392,484 | A * | 2/1995 | Stoltzfus | 15/235.7 |
| 5,803,676 | A | 9/1998 | Wienss | |
| 5,815,975 | A | 10/1998 | Rambo et al. | |
| 6,101,915 | A | 8/2000 | Sinclair | |
| 6,176,031 | B1 * | 1/2001 | Ramsey | 42/90 |
| 6,206,620 | B1 | 3/2001 | Burns | |
| D445,655 | S * | 7/2001 | Maddox | D8/17 |
| 6,464,592 | B1 | 10/2002 | Quast | |
| 6,630,034 | B1 | 10/2003 | Schnell | |
| 6,981,345 | B1 | 1/2006 | Gunn et al. | |
| 7,418,756 | B1 | 9/2008 | Ortega | |
| 2003/0091401 | A1 | 5/2003 | Thompson | |

* cited by examiner

*Primary Examiner*—Stephen M Johnson
(74) *Attorney, Agent, or Firm*—Antoinette M. Tease

(57) ABSTRACT

A rifle bolt cleaning tool comprising a single piece of material with an annular bolt scraping chamber comprising a bottom and two inner walls that extend from the bottom of the scraping chamber upward and spread outward to form two top surfaces of the scraping chamber. The inner walls of the scraping chamber are concave in shape so as to fit snugly around a tail end of a rifle bolt. The distance between the two inner walls of the scraping chamber is roughly equivalent to the outside diameter of a rifle bolt. The inner walls of the scraping chamber extend upward from the bottom of the scraping chamber by a distance that is slightly greater than the length of the tail end of the bolt.

2 Claims, 2 Drawing Sheets

RIFLE BOLT CLEANING TOOL

CROSS-REFERENCE TO RELATED APPLICATION

This application claims priority back to U.S. Patent Application No. 61/010,693 filed on 11 Jan. 2008, the contents of which are incorporated herein by reference.

BACKGROUND OF THE INVENTION

1. Field of the Invention

The present invention relates generally to the field of semi-automatic and fully automatic firearms, and more specifically, to a bolt cleaner for firearms that utilize a rotating breech bolt (for example, the M-4 carbine, M16 and AR-15 rifles).

2. Description of the Related Art

The components included in the bolt carrier portion of a semi-automatic or fully automatic firearm are responsible for feeding live ammunition from the magazine, inserting it into the chamber, providing the firing pin strike that initiates the firing of the ammunition, and extracting and ejecting the spent round from the firing chamber. The operating system of these firearms routes high-pressure gas from the fired cartridge case directly into the bolt carrier to provide the necessary energy to operate the bolt once for every round fired. A problem that is unique to this "direct gas impingement" design arises with the accumulation of carbon from the gunpowder residue collecting inside the bolt carrier and on the aft or tail end of the bolt, in and around the bolt's gas sealing rings. If this carbon fouling is not removed regularly, the action of the bolt and bolt carrier can be slowed and eventually interrupted, thus causing the firearm to "jam" or fail to complete the process of extracting an empty round and loading a live one. In circumstances where the firearm is employed in a military or law enforcement application, these sudden stoppages can be life-threatening to the operator.

Current methods for cleaning carbon deposits from a bolt can best be described as "free-hand" in that a person takes a cleaning brush, pocket knife, modified brass cartridge case or the like and attempts to scrape away the carbon on the tail section of the bolt. These methods are imprecise, however, and they also risk scraping the gas sealing rings, which are situated immediately ahead of the tail section of the bolt where the carbon deposits build up. If the gas scaling rings are dislodged or damaged by a cleaning tool, the rifle operation will be disabled.

Accordingly, it is an object of the present invention to provide a means of cleaning the bolt that can be readily accomplished in low light conditions, harsh operating environments, and by gloved hands, if necessary. It is a further object of the present invention to provide a tool that accomplishes precise cleaning of all of the edges on the tail end of the bolt. It is a further object of the present invention to provide a bolt cleaning tool that scrapes only the tail end of the bolt and that does not come into contact with the gas sealing rings. Yet another object of the present invention is to provide a bolt cleaning tool that is comprised of a single piece and that has no other parts that can be lost or misplaced. Finally, it is an object of the present invention to provide a bolt cleaning tool that is portable, light and small so that it can be carried in the field without burdening the operator with extra weight or bulk.

BRIEF SUMMARY OF THE INVENTION

The present invention is a rifle bolt cleaning tool comprising a single piece of material with an annular bolt scraping chamber comprising a bottom and two inner walls that extend from the bottom of the scraping chamber upward and spread outward to form two top surfaces of the scraping chamber; wherein the inner walls of the scraping chamber are concave in shape so as to fit snugly around a tail end of a rifle bolt; and wherein the distance between the two inner walls of the scraping chamber is roughly equivalent to the outside diameter of a rifle bolt. Preferably, the inner walls of the scraping chamber extend upward from the bottom of the scraping chamber by a distance that is slightly greater than the length of the tail end of the bolt.

In a preferred embodiment, the present invention further comprises two top surfaces that lie outside of and are slightly higher than the top surfaces of the scraping chamber; wherein the top surfaces of the rifle bolt cleaning tool hold securely between them a portion of a rifle bolt that holds gas sealing rings; and wherein the portion of the rifle bolt that holds the gas sealing rings has an outside diameter, there is a distance between the two top surfaces of the rifle bolt cleaning tool, and the distance between the two top surfaces of the rifle bolt cleaning tool is roughly equivalent to the outside diameter of the portion of the rifle bolt that holds the gas sealing rings. Preferably, the underside of the portion of the rifle bolt that holds the gas sealing rings comes into contact with the top surfaces of the annular bolt scraping chamber when the bolt is inserted into the scraping chamber.

In a preferred embodiment, the present invention further comprises a firing pin cutout area for cleaning a firing pin and/or a screwdriver cutout area for use as a screwdriver. Preferably, the present invention further comprises a cleaning cloth cutout area and a bolt carrier cleaning edge for using a cleaning cloth to clean a bolt carrier.

In a preferred embodiment, the rifle bolt cleaning tool weighs approximately 1.5 ounces and is approximately 3.5 inches long and less than 1.0 inch wide.

REFERENCE NUMBERS

Figure 1:
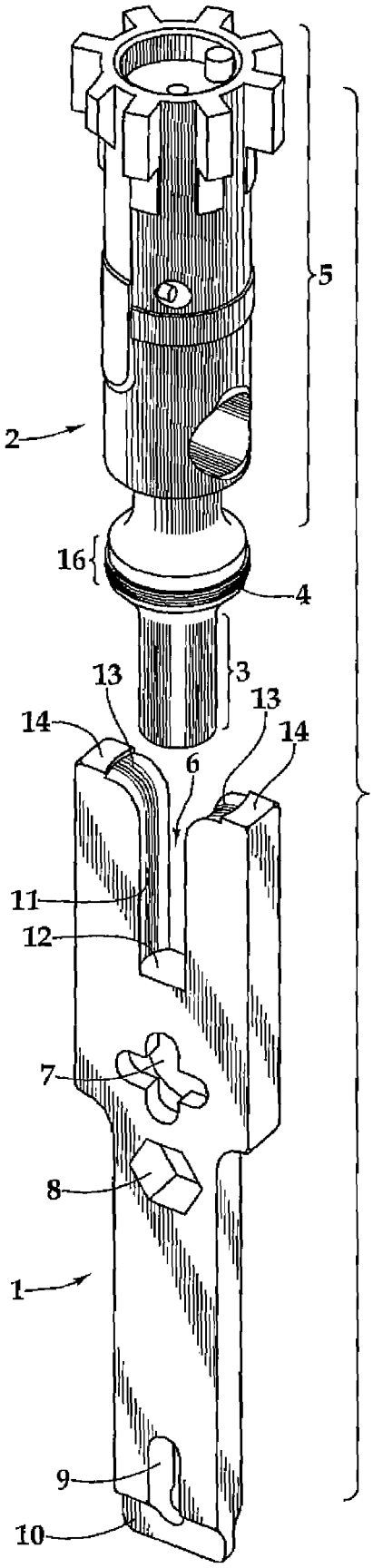
FIG. 1 is an exploded perspective view of the bolt and rifle bolt cleaning tool of the present invention.

1 Rifle bolt cleaning tool
2 Bolt
3 Tail end (of bolt)
4 Gas sealing rings
5 Front end (of bolt)
6 Annular bolt scraping chamber
7 Firing pin cutout area
8 Screwdriver cutout area
9 Cleaning patch cutout area
10 Bolt carrier cleaning edge
11 Inner wall (of scraping chamber)
12 Bottom (of scraping chamber)
13 Top surface (of scraping chamber)
14 Top surface (of rifle bolt cleaning tool)
15 Cleaning cloth
16 Portion of bolt that holds the gas sealing rings

DETAILED DESCRIPTION OF INVENTION

FIG. 1 is an exploded perspective view of the bolt and rifle bolt cleaning tool of the present invention. As shown in this figure, the rifle bolt cleaning tool 1 is a single piece without any separate parts that can be lost or misplaced. It has no attachments and no extensions or protrusions that can break off or cause injury. The rifle bolt cleaning tool 1 is preferably comprised of any suitable and durable material, including, but not limited to, metal and plastic. The rifle bolt cleaning tool 1 is designed to be hard enough to easily scrape away carbon and other contaminants from the bolt without scratching or otherwise damaging the surface of the bolt.

The bolt 2 is comprised of a tail end 3, gas sealing rings 4, and a front end 5. The rifle bolt cleaning tool 3 only cleans the tail end 3 of the bolt 2.

The rifle bolt cleaning tool 1 is comprised of an annular bolt scraping chamber 6, an optional firing pin cutout area 7, an optional screwdriver cutout area 8, an optional cleaning patch cutout area 9, and an optional bolt carrier cleaning edge 10. The inside diameter of the annular bolt scraping chamber 6 (referring to FIG. 8, the distance between the center 11' of one inner wall to the center 11' of the other inner wall) is roughly equivalent to the outside diameter of the tail end 3 of the bolt 2. The inner walls 11 of the scraping chamber 6 are concave in shape so that they fit snugly around the tail end 3, which is circular in shape. The inner walls 11 extend from the bottom 12 of the scraping chamber 6 upward for a distance that is slightly greater than the length of the tail end 3 of the bolt 2 and then spread outward to form the top surfaces 13 of the scraping chamber 6. The rifle bolt cleaning tool 1 itself comprises two top surfaces 14 that lie outside of and are slightly higher than the top surfaces 13 of the scraping chamber 6. The function of the top surfaces 14 of the rifle bolt cleaning tool 1 is to hold securely between them that portion 16 of bolt 2 that holds the gas sealing rings 4, as shown more clearly in FIG. 5. Thus, the distance between the two top surfaces 14 of the rifle bolt cleaning tool 1 is preferably roughly equivalent to the outside diameter of that portion 16 of the bolt 2 that holds the gas sealing rings 4.

The optional firing pin cutout area 7 can be used to clean carbon deposits off of a firing pin (not shown). The optional screwdriver cutout area 8 can be used as a screwdriver. The functions of the optional cleaning cloth cutout area 9 and bolt carrier cleaning edge 10 are shown in FIG. 2.

Figure 2:
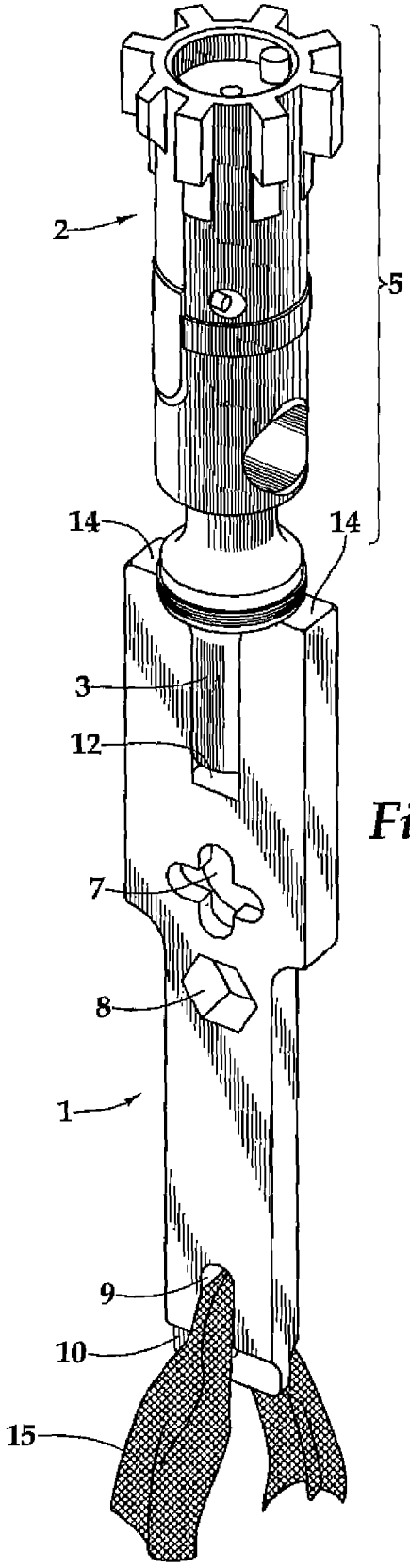
FIG. 2 is a perspective view of the bolt and rifle bolt cleaning tool of the present invention.

FIG. 2 is a perspective view of the bolt and rifle bolt cleaning tool of the present invention. This figure shows how the tail end 3 of the bolt 2 fits into the annular bolt scraping chamber 6. As shown, the inner walls 11 of the scraping chamber 6 are preferably longer than the tail end 3 of the bolt 2 so as to ensure that the underside of the portion 16 of the bolt 2 that holds the gas sealing rings 4 will come into contact with the top surfaces 13 of the scraping chamber 6. To use the rifle bolt cleaning tool 1, the tail end 3 of the bolt 2 is inserted into the annular bolt scraping chamber 6 until the top surfaces 13 of the scraping chamber 6 come into contact with the underside of the portion 16 of the bolt that holds the gas sealing rings 4, and then the bolt 2 is rotated by hand. In this manner, the inner walls 11 (including the top surfaces 13) of the scraping chamber 6 remove carbon deposits that have accumulated on the tail end 3 of the bolt 2. As is apparent from the figures, the size and shape of the scraping chamber 6 are specifically tailored so that the scraping chamber 6 fits snugly around the tail end 3 of the bolt 2.

A cleaning cloth 15 may be inserted into the cleaning cloth cutout 9 and folded around the bolt carrier cleaning edge 10. This end of the rifle bolt cleaning tool 1 would then be inserted into the bolt carrier (not shown) to clean the inside of the bolt carrier.

Figure 3:
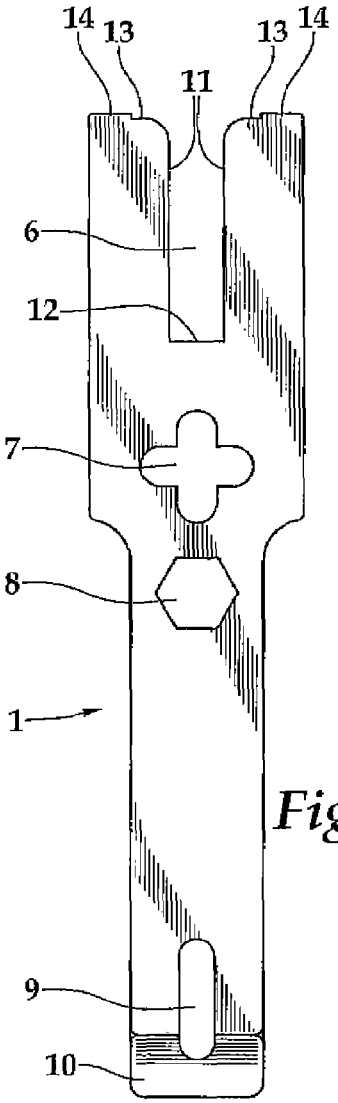
FIG. 3 is a front view of the rifle bolt cleaning tool of the present invention.

FIG. 3 is a front view of the rifle bolt cleaning tool of the present invention. As illustrated in this figure, the annular bolt scraping chamber 6 comprises four scraping edges. The first two scraping edges are the inner walls 11 of the scraping chamber 6. These two scraping edges scrape the carbon deposits from the sides of the tail end 3 of the bolt 2. The next two scraping edges are the top surfaces 13 of the scraping chamber 6. These two scraping edges scrape the carbon deposits from the underside of the portion 16 of the bolt that holds the gas sealing rings 4.

Figure 4:
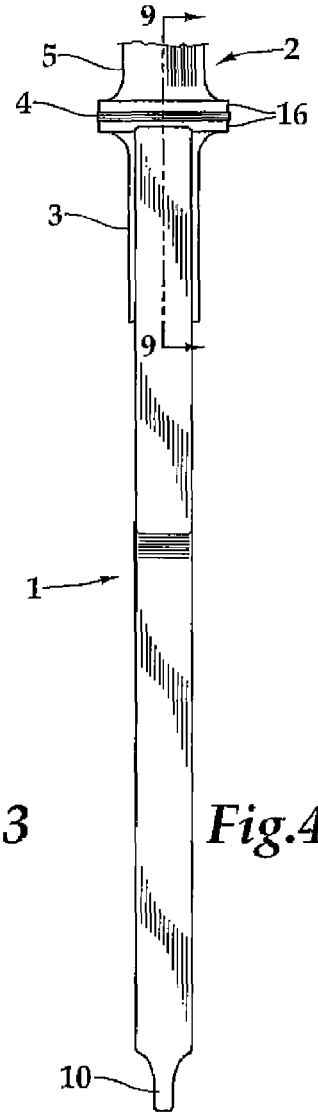
FIG. 4 is a side view of the rifle bolt cleaning tool of the present invention shown with the bolt.
Figure 5:
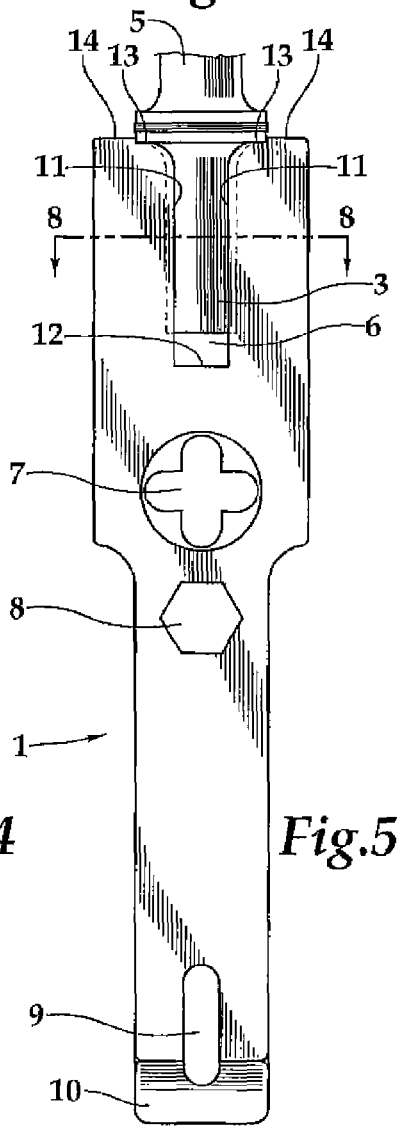
FIG. 5 is a rear view of the rifle bolt cleaning tool of the present invention shown with the bolt.

FIG. 4 is a side view of the rifle bolt cleaning tool of the present invention shown with the bolt. As shown in this figure and FIG. 5, the inner walls 11 and top surfaces 13 of the scraping chamber 6 cradle the tail end 3 snugly so as to accomplish their scraping function. These figures also show how the top surfaces 14 of the rifle bolt cleaning tool 1 are spaced so that the distance between them roughly equals the outside diameter of the portion 16 of the bolt 2 that holds the gas sealing rings 4. FIG. 5 is a rear view of the rifle bolt cleaning tool of the present invention shown with the bolt.

Figure 6:
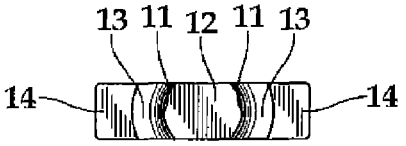
FIG. 6 is a top view of the rifle bolt cleaning tool of the present invention.

FIG. 6 is a top view of the rifle bolt cleaning tool of the present invention. This figure illustrates the concave shape of the inner walls 11 of the scraping chamber 6.

Figure 7:
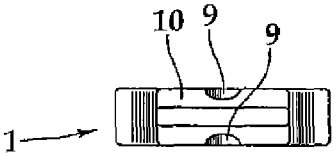
FIG. 7 is a bottom view of the rifle bolt cleaning tool of the present invention.

FIG. 7 is a bottom view of the rifle bolt cleaning tool of the present invention. This figure shows the cleaning cloth cutout 9 and the bolt carrier cleaning edge 10.

Figure 8:
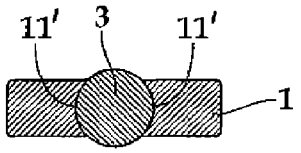
FIG. 8 is a lateral section view of the bolt inserted into the annular bolt scraping chamber.

FIG. 8 is a lateral section view of the bolt inserted into the annular bolt scraping chamber. This figure is taken at line 8-8 of FIG. 5. This figure shows the concave shape of the inner walls 11 of the scraping chamber 6 and how they surround the tail end 3 of the bolt 2.

Figure 9:
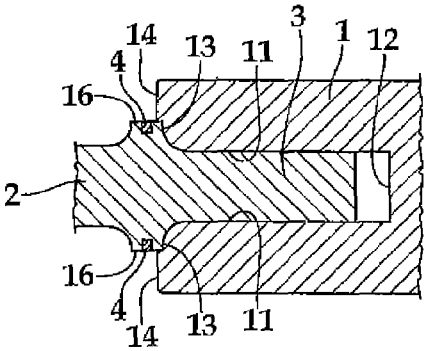
FIG. 9 is a longitudinal section view of the bolt and annular bolt scraping chamber.

FIG. 9 is a longitudinal section view of the bolt and annular bolt scraping chamber. This figure is taken at line 9-9 of FIG. 4. This figure shows how the inner walls 11 and top surfaces 13 of the scraping chamber 6 completely surround the tail end 3 of the bolt 2 and the underside of the portion 16 of the bolt that holds the gas sealing rings 4.

In a preferred embodiment, the rifle bolt cleaning tool 1 weighs approximately one and one half (1.5) ounces, is three and one half (3.5) inches long and less than one (<1.0) inch wide, and is smaller and lighter than many pocket knives. The rifle bolt cleaning tool 1 is designed to be carried in a butt stock compartment on the weapon, inside a uniform pocket, inside the pistol grip, or attached to a tactical vest by a short piece of parachute cord.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. A rifle bolt cleaning tool comprising:

a single piece of material with an annular bolt scraping chamber comprising a bottom and two inner walls that extend from the bottom of the scraping chamber upward and spread outward to form two top surfaces of the scraping chamber; and two top surfaces that lie outside of and are slightly higher than the top surfaces of the scraping chamber;

wherein the inner walls of the scraping chamber are concave in shape so as to fit snugly around a tail end of a rifle bolt;

wherein the distance between the center of one of the inner walls of the scraping chamber and the center of the other inner wall of the scraping chamber is roughly equivalent to the outside diameter of the tail end a rifle bolt, wherein the top surfaces of the rifle bolt cleaning tool hold securely between them a portion of a rifle bolt that holds gas sealing rings; and wherein the portion of the rifle bolt that holds the gas sealing rings has an outside diameter, there is a distance between the two top surfaces of the ride bolt cleaning tool, and the distance between the two top surfaces of the rifle bolt cleaning tool is roughly equivalent to the outside diameter of the portion of the rifle bolt that holds the gas sealing rings.

2. The rifle bolt cleaning tool of claim 1, wherein the portion of the rifle bolt that holds the gas sealing rings comprises an underside; and wherein the underside of the portion of the rifle bolt that holds the gas sealing rings comes into contact with the top surfaces of the annular bolt scraping chamber when the bolt is inserted into the scraping chamber.

* * * * *